US011835287B2

(12) United States Patent
Chhajed et al.

(10) Patent No.: US 11,835,287 B2
(45) Date of Patent: Dec. 5, 2023

(54) REFRIGERATION UNIT

(71) Applicant: Whirlpool Corporation, Benton Harbor, MI (US)

(72) Inventors: Rahul Subhash Chhajed, Pune (IN); Jacob Charles Ickes, Baroda, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/591,401

(22) Filed: Feb. 2, 2022

(65) Prior Publication Data

US 2023/0243570 A1 Aug. 3, 2023

(51) Int. Cl.
*F25D 17/06* (2006.01)
*F25D 21/14* (2006.01)
*F25B 39/02* (2006.01)

(52) U.S. Cl.
CPC ..... *F25D 17/067* (2013.01); *F25B 39/02* (2013.01); *F25D 21/14* (2013.01)

(58) Field of Classification Search
CPC ..... F25D 17/067; F25D 21/14; F25D 17/04; F25D 17/06; F25D 2317/066; F25D 2317/0666; F25D 2321/144; F25B 39/02; F24F 13/08; F24F 13/082
See application file for complete search history.

(56) References Cited

U.S. PATENT DOCUMENTS

| | | | |
|---|---|---|---|
| 5,997,254 | A | 12/1999 | Tosaki |
| 6,457,955 | B1 | 10/2002 | Cheng |
| 6,918,259 | B2 | 7/2005 | Anderson et al. |
| 9,140,266 | B2 | 9/2015 | Horng et al. |
| 10,852,049 | B2 | 12/2020 | Yi et al. |
| 11,143,433 | B2 | 10/2021 | Bauer et al. |
| 2005/0095121 | A1 | 5/2005 | Vithani |
| 2017/0284724 | A1 * | 10/2017 | Lee ..... F25B 5/02 |
| 2021/0172668 | A1 | 6/2021 | Park et al. |
| 2021/0172670 | A1 | 6/2021 | Lee et al. |
| 2022/0011038 | A1 | 1/2022 | Yoon |

(Continued)

FOREIGN PATENT DOCUMENTS

| | | | |
|---|---|---|---|
| CN | 206300403 | U | 7/2017 |
| EP | 3071908 | A1 | 9/2016 |

(Continued)

*Primary Examiner* — Henry T Crenshaw
*Assistant Examiner* — Kamran Tavakoldavani
(74) *Attorney, Agent, or Firm* — Price Heneveld LLP

(57) ABSTRACT

A refrigeration unit includes a storage compartment, an evaporator compartment, an evaporator disposed within the evaporator compartment, a drain pan beneath the evaporator and having first and second sloped surfaces, and a panel between the storage and evaporator compartments that defines an opening. The storage compartment is in fluid communication with the evaporator compartment via the opening. The refrigeration unit also includes an evaporator fan that delivers air from the evaporator compartment to the storage compartment via the opening, and an evaporator fan grille coupled to the panel and extending outward therefrom into the storage compartment. The evaporator fan grille includes a body that extends over the opening and that is in a spaced-relationship with the panel, and at least one spacer feature extending from the panel to the body.

18 Claims, 6 Drawing Sheets

(56) References Cited

U.S. PATENT DOCUMENTS

| | | | | |
|---|---|---|---|---|
| 2022/0275992 | A1* | 9/2022 | Park | F25D 17/065 |
| 2022/0404086 | A1* | 12/2022 | Jung | F25D 17/067 |

FOREIGN PATENT DOCUMENTS

| | | | |
|---|---|---|---|
| JP | 5663964 | U | 5/1981 |
| JP | 5797887 | U | 6/1982 |
| JP | 60111868 | A | 6/1985 |
| KR | 20040050481 | A | 6/2004 |
| KR | 100918447 | B1 | 9/2009 |

* cited by examiner

REFRIGERATION UNIT

BACKGROUND OF THE DISCLOSURE

The present disclosure generally relates to a refrigeration unit and, more specifically, to a fan grille for a refrigeration unit.

SUMMARY OF THE DISCLOSURE

According to one aspect of the present disclosure, a refrigeration unit includes a storage compartment, an evaporator compartment, an evaporator disposed within the evaporator compartment, a drain pan beneath the evaporator and having first and second sloped surfaces, and a panel between the storage and evaporator compartments that defines an opening. The storage compartment is in fluid communication with the evaporator compartment via the opening. The refrigeration unit also includes an evaporator fan that delivers air from the evaporator compartment to the storage compartment via the opening, and an evaporator fan grille coupled to the panel and extending outward therefrom into the storage compartment. The evaporator fan grille includes a body that extends over the opening and that is in a spaced-relationship with the panel, and at least one spacer feature extending from the panel to the body.

According to another aspect of the present disclosure, a fan grille for a refrigeration unit includes a body that includes a grille panel that defines a grille aperture and a saucer coupled to the grille panel by at least one connecting feature, and at least one spacer feature that extends outward from the body.

According to yet another aspect of the present disclosure, a refrigeration unit includes a storage compartment, an evaporator compartment, an evaporator disposed within the evaporator compartment, and a drain pan beneath the evaporator. The drain pan includes a first sloped surface that slopes downward generally toward a drain hole of the drain pan and a second sloped surface that slopes generally downward toward the drain pan. The angle between the first and second sloped surfaces is greater than 45 degrees.

These and other features, advantages, and objects of the present disclosure will be further understood and appreciated by those skilled in the art by reference to the following specification, claims, and appended drawings.

Figure 1:
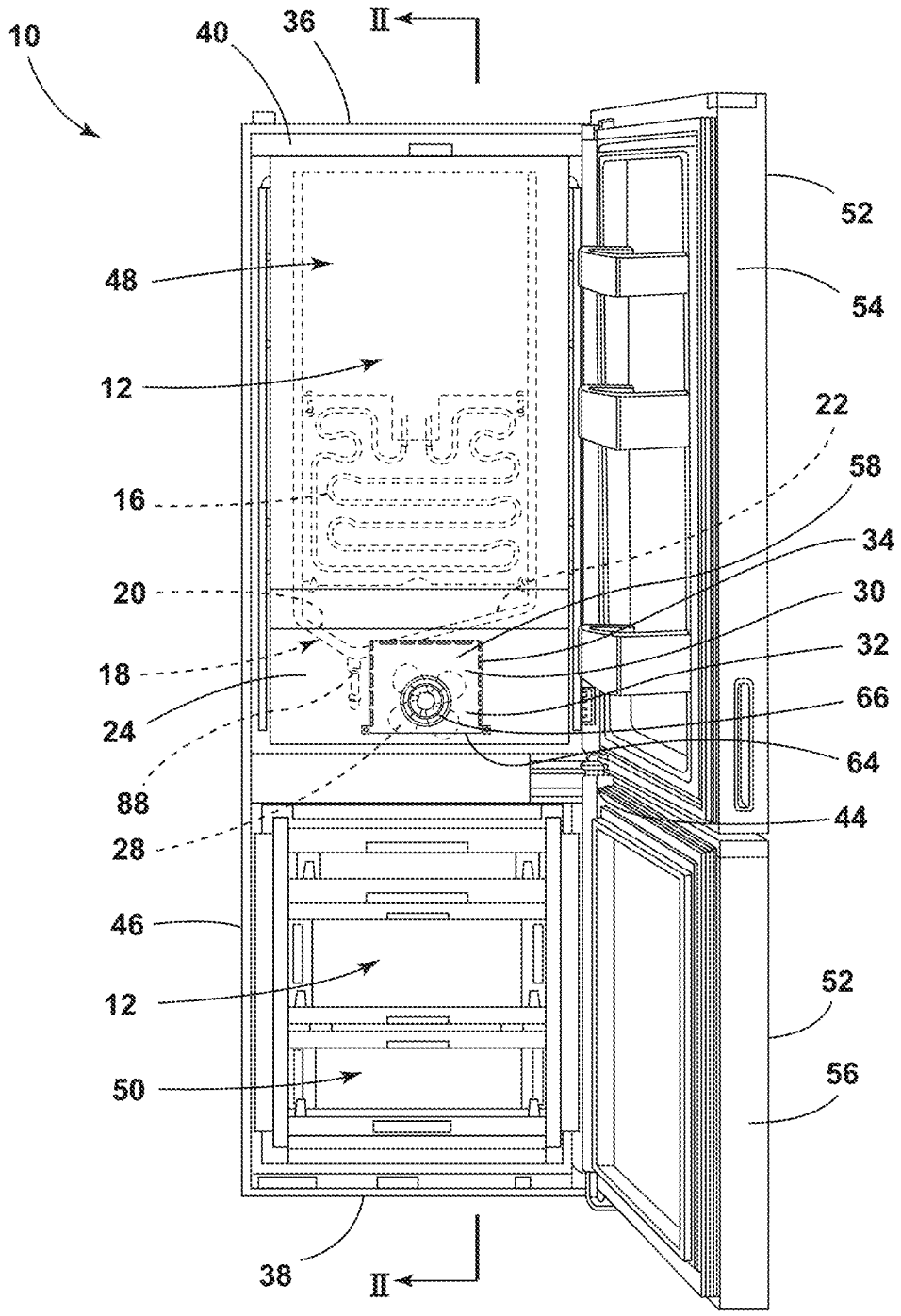
FIG. 1 is a front elevational view of a refrigeration unit of the present disclosure, illustrating an evaporator and a drain pan in phantom, and a fan grille.

The components in the figures are not necessarily to scale, emphasis instead being placed upon illustrating the principles described herein.

DETAILED DESCRIPTION

The present illustrated embodiments reside primarily in combinations of apparatus components related to a refrigeration unit. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring now to FIGS. 1-7, reference numeral 10 generally designates a refrigeration unit. The refrigeration unit 10 includes a storage compartment 12 and an evaporator compartment 14. An evaporator 16 is disposed within the evaporator compartment 14. A drain pan 18 is positioned beneath the evaporator 16 and includes first and second sloped surfaces 20, 22. A panel 24 is positioned between the storage compartment 12 and the evaporator compartment 14. The panel 24 includes an opening 26, and the storage compartment 12 is in fluid communication with the evaporator compartment 14 via the opening 26. An evaporator fan 28 delivers air from the evaporator compartment 14 to the storage compartment 12 via the opening 26. An evaporator fan grille 30 is coupled to the panel 24 and extends outward therefrom into the storage compartment 12. The evaporator fan grille 30 includes a body 32 that extends over the opening 26 and that is in a spaced-relationship with the panel 24, and at least one spacer feature 34 that extends from the panel 24 to the body 32.

Figure 2:
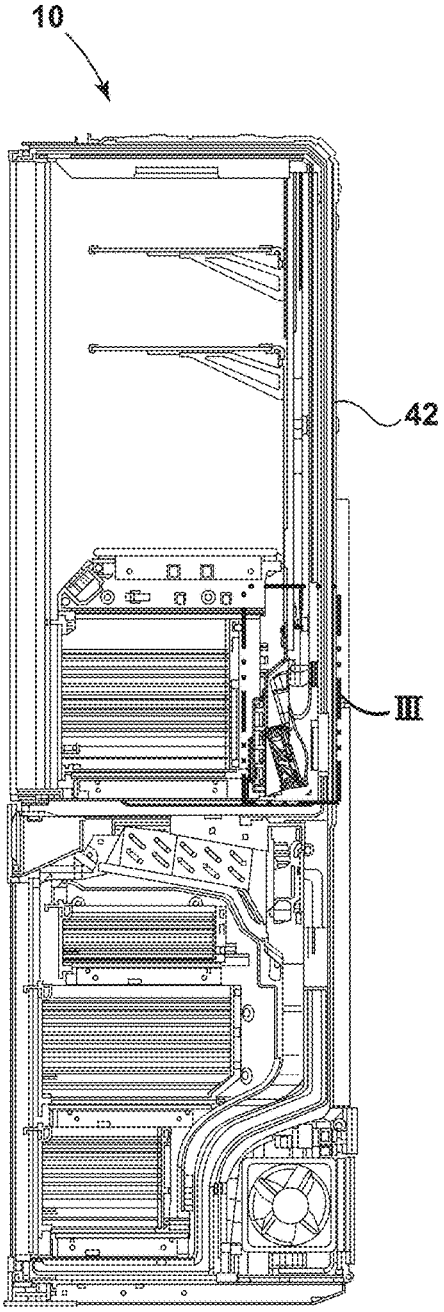
FIG. 2 is a cross-sectional view of the refrigeration unit of FIG. 1 taken at line II-II showing an evaporator, an evaporator fan, a panel, and a fan grille.

Referring now to FIGS. 1 and 2, the refrigeration unit 10 includes a top 36 and a bottom 38 opposite the top 36. A front side 40 and a rear side 42 opposite the front side 40 extend between the top 36 and the bottom 38. A right side 44 and a left side 46 opposite the right side 44 are disposed between the front and rear sides 40, 42 and extend between the top 36 and the bottom 38. Exterior surfaces of the refrigeration unit 10, such as trim or paneling, may comprise the top 36, bottom 38, rear side 42, left side 46, and/or right side 44 of the refrigeration unit 10.

The refrigeration unit 10 includes at least one storage compartment 12 in which items are configured to be stored in a temperature-controlled environment. In the embodiment illustrated in FIG. 1, the refrigeration unit 10 includes two storage compartments 12—a refrigerator compartment 48 and a freezer compartment 50. The refrigeration unit 10 further includes at least one storage compartment door 52. In the embodiment illustrated in FIG. 1, the refrigeration unit 10 includes two storage compartment doors—a refrigerator compartment door 54 and a freezer compartment door 56. The refrigerator and freezer compartment doors 54, 56 are coupled to the refrigeration unit 10 proximate to the front side 40 and are operable between closed and open positions, as illustrated in FIG. 1. In the closed position (not shown), the exterior surfaces of the refrigerator and freezer compartment doors 54, 56 may be the front side 40 of the refrigeration unit 10. In the illustrated embodiment, the refrigerator compartment door 54 provides access to the refrigerator compartment 48 and the freezer compartment door 56 provides access to the freezer compartment 50. A variety of styles of refrigeration units 10 with varying numbers of storage compartments and doors are contemplated. Referring still to FIGS. 1 and 2, the refrigerator compartment 48 is positioned nearer to the top 36 of the refrigeration unit 10 than the freezer compartment 50. As such, the refrigeration unit 10 is configured as a bottom-freezer refrigeration appliance.

Figure 3:
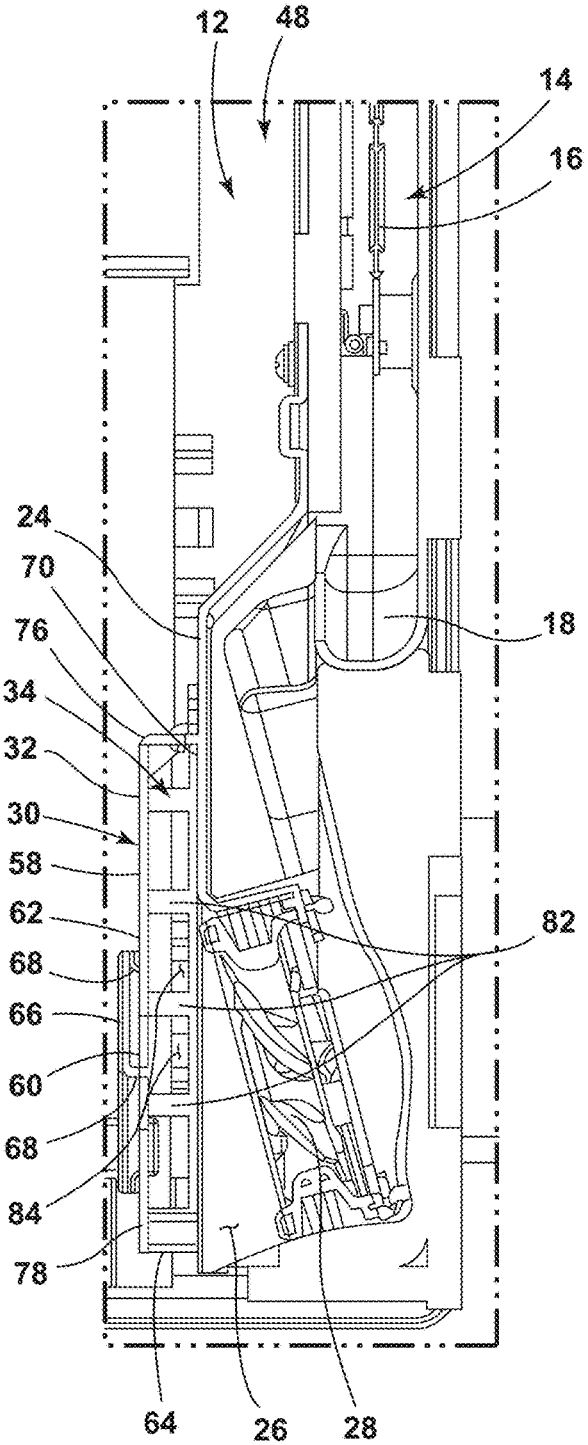
FIG. 3 is an enlarged view of the panel, evaporator fan, and fan grille of FIG. 2 taken at area III.

Referring now to FIGS. 1-3, the refrigeration unit 10 includes the evaporator compartment 14. As illustrated in FIG. 2, the evaporator compartment 14 is positioned rearward of the storage compartment 12. The evaporator compartment 14 and the storage compartment 12 are generally separated by the panel 24 that extends between the evaporator and storage compartments 14, 12. In various embodiments, a plurality of panels 24 and other components may extend between the evaporator compartment 14 and the storage compartment 12. The evaporator 16 of the refrigeration unit 10 is disposed within the evaporator compartment 14, as illustrated in FIGS. 2 and 3. In operation of the refrigeration unit 10, heat is transferred from the air within the evaporator compartment 14 to evaporating refrigerant within the evaporator 16, such that the air is cooled. In the embodiment illustrated in FIGS. 1-3, the evaporator compartment 14 is separated from the refrigerator compartment 48 of the refrigeration unit 10 by the panel 24, and the cooled air within the evaporator compartment 14 is configured to flow into the refrigerator compartment 48 to cool the refrigerator compartment 48, as described further herein.

Referring now to FIGS. 2 and 3, the panel 24 between the evaporator compartment 14 and the storage compartment 12 defines the opening 26 through which the storage compartment 12 is in fluid communication with the evaporator compartment 14. In some embodiments, the opening 26 is an aperture defined by the panel 24. In the embodiment illustrated in FIGS. 2 and 3, the opening 26 is defined by an edge of the panel 24 along with other components of the refrigeration unit 10. As illustrated in FIGS. 2 and 3, a portion of the panel 24 defines the storage compartment 12 of the refrigeration unit 10. In various embodiments, the refrigeration unit 10 includes the evaporator fan 28, which is configured to deliver air from the evaporator compartment 14 to the storage compartment 12 through the opening 26 defined by the panel 24. In the embodiment illustrated in FIG. 3, the evaporator fan 28 is positioned within the opening 26 defined by the panel 24.

Referring now to FIGS. 1-5, the refrigeration unit 10 includes the evaporator fan grille 30. The evaporator fan grille 30 includes the body 32. The body 32 of the evaporator fan grille 30 extends over the opening 26 that is defined by the panel 24. The body 32 is in a spaced-relationship with the panel 24, as illustrated in FIG. 3. In various embodiments, the body 32 of the evaporator fan grille 30 includes a grille panel 58 that defines a grille aperture 60. As illustrated in FIG. 4A, in some implementations, the grille panel 58 is generally rectangular as viewed from a front elevational view of the refrigeration unit 10, as shown in FIG. 4A. In the embodiment illustrated in FIG. 4A, the grille panel 58 includes a substantially planar surface 62 that faces toward the front side 40 of the refrigeration unit 10. As illustrated in FIGS. 4A and 4B, the grille panel 58 defines the grille aperture 60. The grille aperture 60 may be one or more of a variety of shapes and sizes, and may be positioned in a variety of positions on the grille panel 58, in various embodiments. In the embodiment illustrated in FIG. 4A, the grille aperture 60 is substantially circular and is vertically offset toward a lower edge 64 of the grille panel 58.

Referring still to FIGS. 1-5, the body 32 of the evaporator fan grille 30 further includes a saucer 66. The saucer 66 is coupled to the grille panel 58 of the body 32 by at least one connecting feature 68. The saucer 66 may be generally circular, in various embodiments. In the embodiment illustrated in FIGS. 4A and 4B, the saucer 66 is generally concentrically aligned with the grille aperture 60 defined by the grille panel 58 of the body 32. In the illustrated embodiment, the saucer 66 includes a concave side 70. As illustrated, the concave side 70 faces away from the evaporator fan 28, which is disposed rearward of the evaporator fan grille 30.

The evaporator fan grille 30 further includes the at least one spacer feature 34. In various embodiments, the at least one spacer feature 34 extends outward from the body 32 of the evaporator fan grille 30 and is coupled to the panel 24 of the refrigeration unit 10. As illustrated in FIG. 3, the at least one spacer feature 34 is coupled to the portion of the panel 24 that defines the storage compartment 12 of the refrigeration unit 10. The at least one spacer feature 34 is configured to space the body 32 of the evaporator fan grille 30 apart from the panel 24 of the refrigeration unit 10 and the opening 26 defined by the panel 24, which may advantageously influence the flow of air from the evaporator compartment 14 to the storage compartment 12, as described further herein.

Figure 4A:
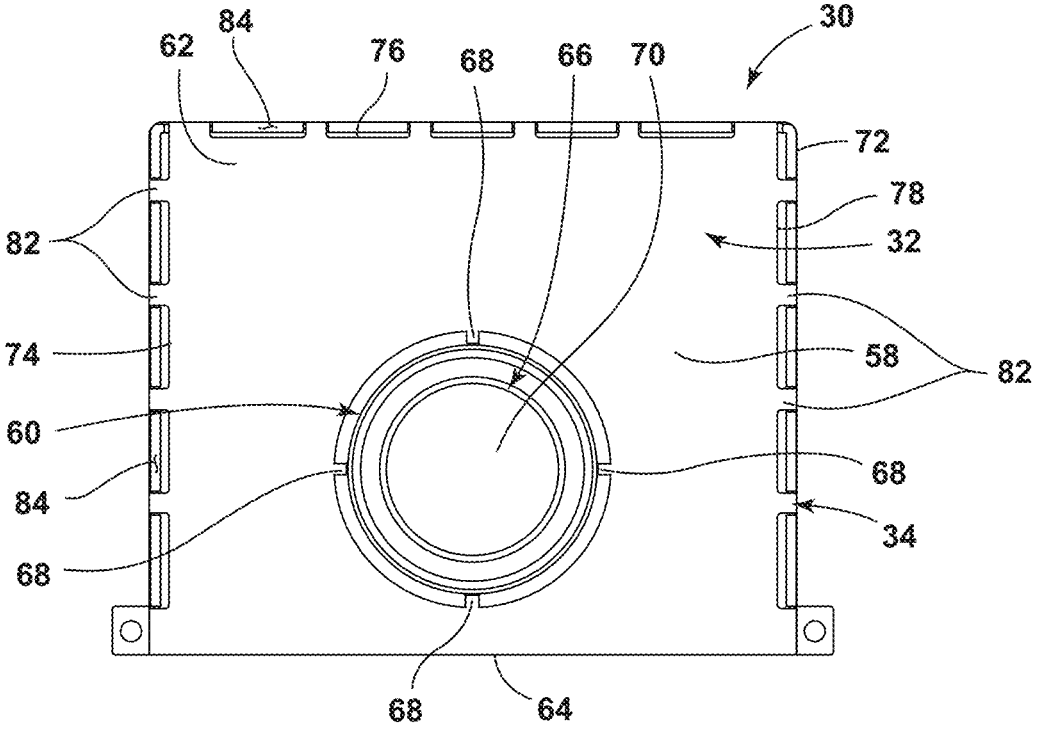
FIG. 4A is a front elevational view of a fan grille.
Figure 4B:
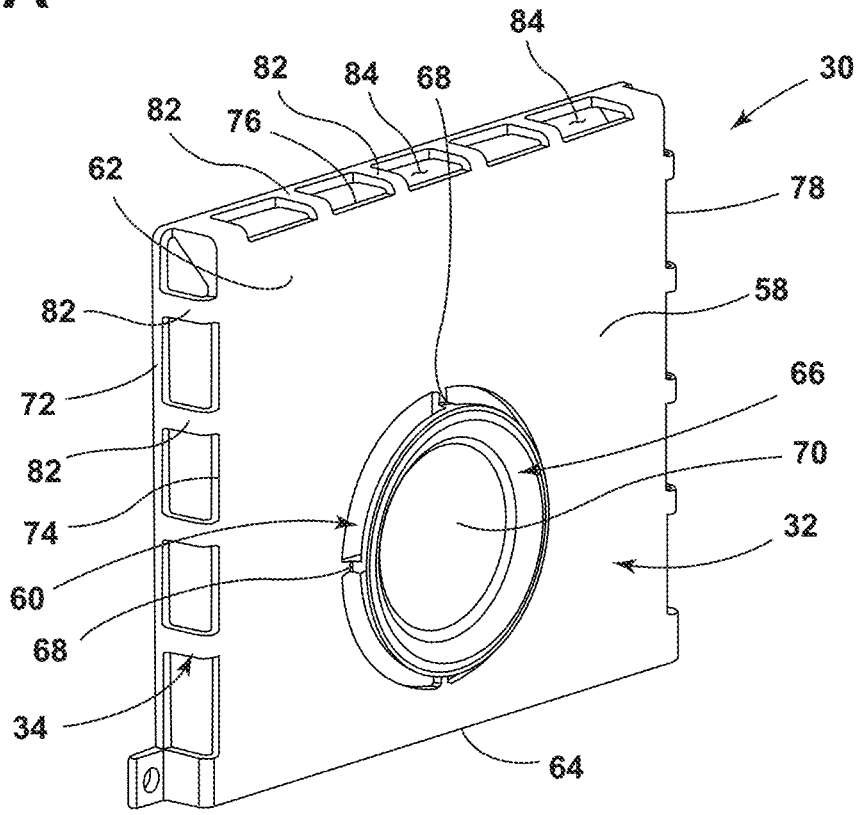
FIG. 4B is a top perspective view of the fan grille of FIG. 4A.
Figure 5:
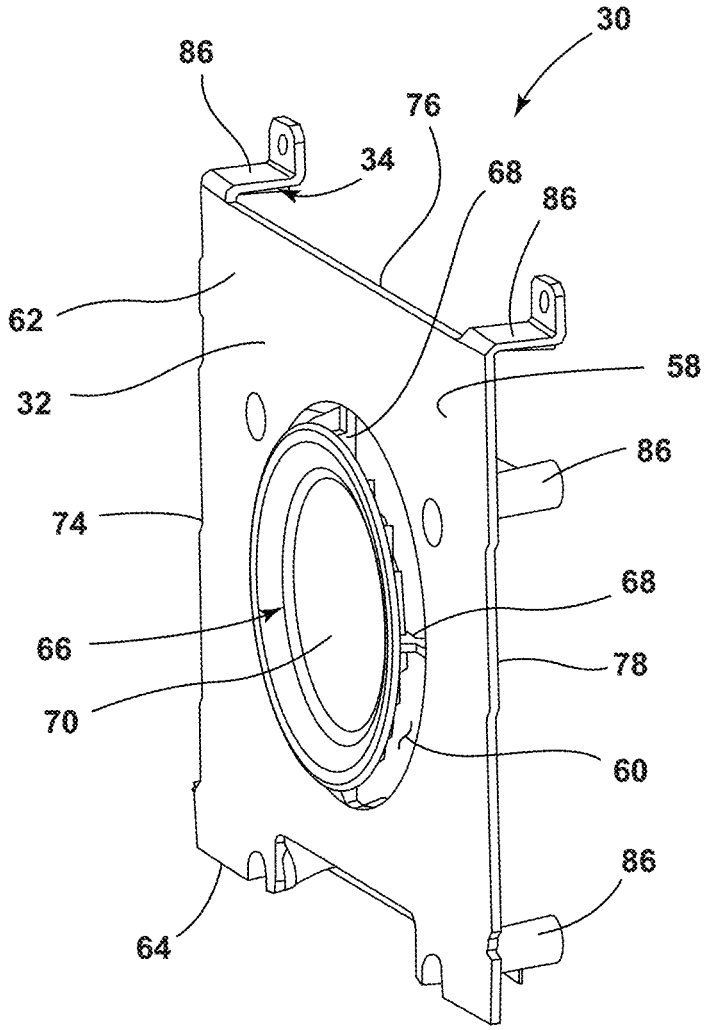
FIG. 5 is a top perspective view of a fan grille.

Referring now to FIGS. 4A and 4B, in some implementations, the at least one spacer feature 34 includes a lip 72. The lip 72 may extend along the panel 24 of the refrigeration unit 10. In the embodiment illustrated in FIG. 4A, the lip 72 extends generally parallel to the left, upper, and right edges 74, 76, 78 of the generally rectangular grille panel 58 of the body 32 of the evaporator fan grille 30. In the illustrated embodiment, the lip 72 does not extend along the lower edge 64 of the grille panel 58. It is contemplated that the lip 72 may additionally extend parallel to the lower edge 64 of the grille panel 58, in some embodiments. As illustrated in FIG. 4B, the at least one spacer feature 34 includes a plurality of pillars 82 that extend between the lip 72 and the grille panel 58 of the body 32. The plurality of pillars 82 may be spaced apart from each other, such that a plurality of spacer feature apertures 84 are at least partially defined by the lip 72 of the at least one spacer feature 34 and the plurality of pillars 82 of the at least one spacer feature 34. In some embodiments of the evaporator fan grille 30, the at least one spacer feature 34 includes a plurality of legs 86 that extend away from the grille panel 58. The plurality of legs 86 may extend between the panel 24 of the refrigeration unit 10 and the grille panel 58, in various embodiments. As illustrated in FIG. 5, the plurality of legs 86 are not connected by the lip 72 in the way that the pillars 82 are in FIGS. 4A and 4B. A variety of types of spacer features 34 are contemplated.

Figure 6:
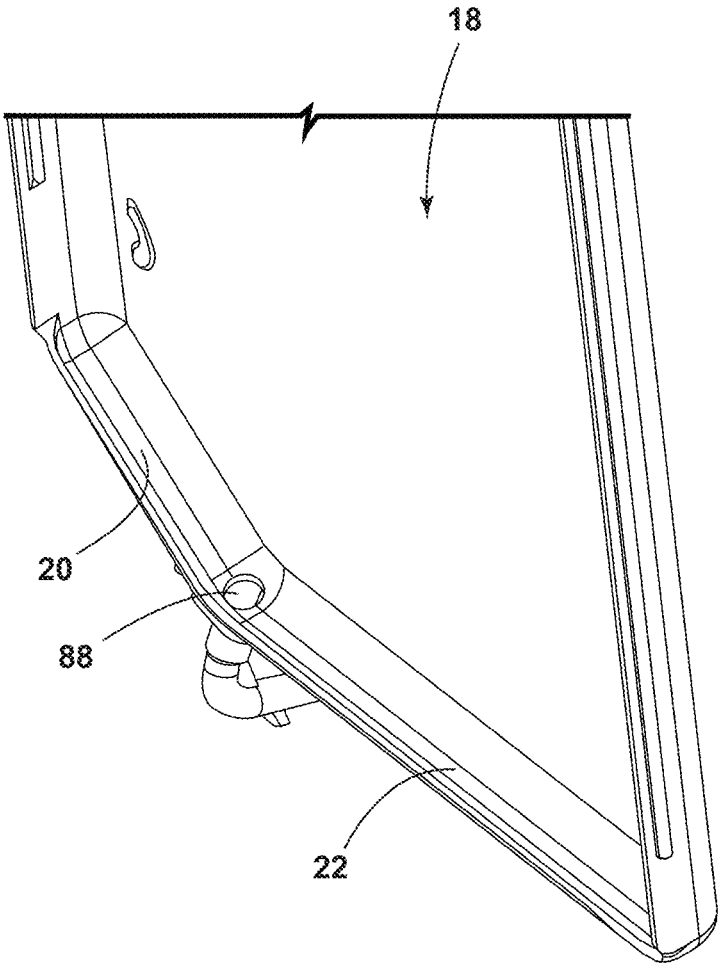
FIG. 6 is a top perspective view of a portion of a drain pan, illustrating first and second sloped surfaces that slope downward generally toward a drain hole.
Figure 7:
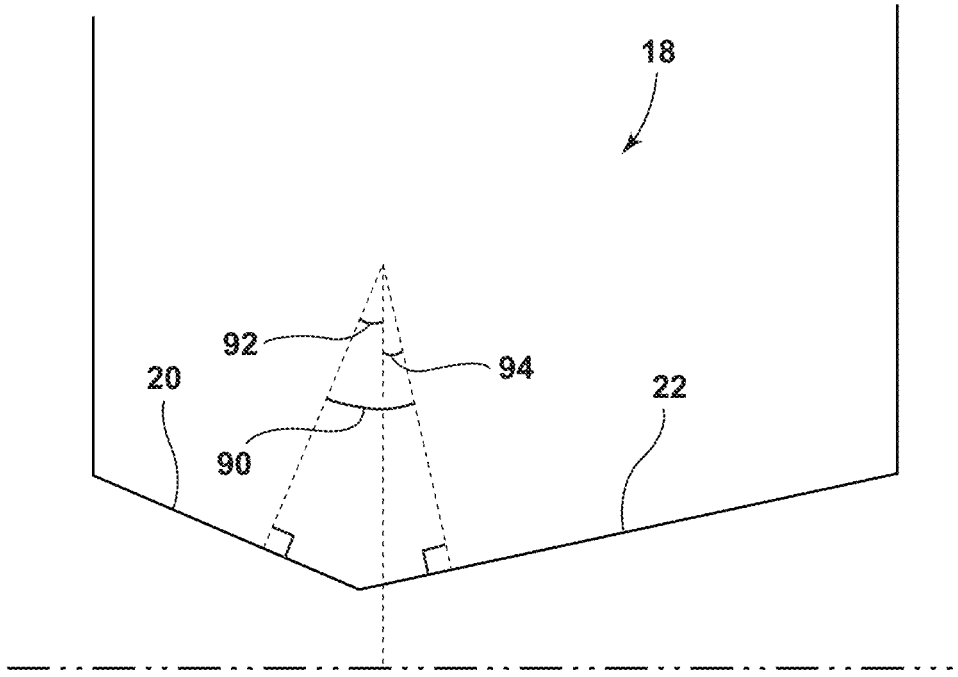
FIG. 7 is a front elevational view of a schematic of a drain pan.

Referring now to FIGS. 1, 6, and 7, the refrigeration unit 10 includes the drain pan 18. The drain pan 18 is positioned beneath the evaporator 16 and is configured to catch condensation dripping from the evaporator 16 and convey the condensation to a drain hole 88 defined by the drain pan 18. In various embodiments, the drain pan 18 includes the first sloped surface 20 that slopes downward generally toward the drain hole 88 of the drain pan 18, and the second sloped surface 22 that slopes downward generally toward the drain hole 88 of the drain pan 18, as illustrated in FIG. 6. Condensation dripping from the evaporator 16 of the refrigeration unit 10 may fall onto the first and/or second sloped surfaces 20, 22 of the drain pan 18 and move along the sloped surfaces 20, 22 to the drain hole 88, as propelled by gravity. As illustrated in FIGS. 1, 6, and 7, the first and second sloped surfaces 20, 22 are on opposite sides of the drain hole 88. For example, the first sloped surface 20 is between the drain hole 88 and the left side 46 of the refrigeration unit 10, and the second sloped surface 22 is positioned between the drain hole 88 and the right side 44 of the refrigeration unit 10. It is contemplated that, in some embodiments, the first sloped surface 20 may be positioned between the drain hole 88 and the right side 44, and the second sloped surface 22 may be positioned between the drain hole 88 and the left side 46. In some implementations, the first and second sloped surfaces 20, 22 are substantially planar.

Referring now to FIG. 7, in some implementations, an angle 90 between the first and second sloped surfaces 20, 22 is greater than 45°. For example, in an exemplary embodiment, the angle 90 between the first and second sloped surfaces 20, 22 is between about 46° and about 48°. In various embodiments, an angle 92 of the first sloped surface 20 of the drain pan 18 relative to a horizontal plane of the refrigeration unit 10 is different than an angle 94 of the second sloped surface 22 of the drain pan 18 relative to the horizontal plane of the refrigeration unit 10. For example, the angle 92 of the first sloped surface 20 of the drain pan 18 relative to the horizontal plane of the refrigeration unit 10 may be about 31°, in some implementations. The angle 94 of the second sloped surface 22 of the drain pan 18 relative to the horizontal plane of the refrigeration unit 10 may be about 15°, in some implementations. The first and second sloped surfaces 20, 22 can have a variety of angles relative to the horizontal plane of the refrigeration unit 10, in various embodiments. In the embodiment illustrated in FIGS. 1, 6, and 7, the drain hole 88 is positioned relatively nearer to the left side 46 of the refrigeration unit 10 than the right side 44 of the refrigeration unit 10, and the first sloped surface 20 of the drain pan 18 is shorter than the second sloped surface 22 of the drain pan 18.

The refrigeration unit 10 of the present disclosure may provide a variety of advantages. For example, the angle 90 of the first and second sloped surfaces 20, 22 of the drain pan 18, in combination with the body 32 of the evaporator fan grille 30 being spaced apart from the panel 24 that defines the opening 26, may prevent water condensate that falls from the evaporator 16 into the drain pan 18 from freezing and obstructing the drain hole 88. In particular, the angle 90 between the first and second sloped surfaces 20, 22 of the drain pan 18 being between 46° and 48°, and the body 32 being spaced apart from the opening 26, such that air blown by the evaporator fan 28 more easily exits into the storage compartment 12 via the spacer feature apertures 84, may significantly reduce the likelihood of water condensate freezing within the drain pan 18.

According to an aspect of the present disclosure, a refrigeration unit includes a storage compartment, an evaporator compartment, an evaporator disposed within the evaporator compartment, a drain pan beneath the evaporator and having first and second sloped surfaces, and a panel between the storage and evaporator compartments that defines an opening. The storage compartment is in fluid communication with the evaporator compartment via the opening. The refrigeration unit also includes an evaporator fan that delivers air from the evaporator compartment to the storage compartment via the opening, and an evaporator fan grille coupled to the panel and extending outward therefrom into the storage compartment. The evaporator fan grille includes a body that extends over the opening and that is in a spaced-relationship with the panel, and at least one spacer feature extending from the panel to the body.

According to another aspect of the present disclosure, the first sloped surface of the drain pan slopes downward generally toward a drain hole of the drain pan at an angle of about 31 degrees relative to a horizontal plane of the refrigeration unit.

According to another aspect, the second sloped surface of the drain pan slopes downward generally toward the drain hole at an angle of about 15 degrees relative to the horizontal plane of the refrigeration unit.

According to yet another aspect, the first and second sloped surfaces slope downward generally toward a drain hole of the drain pan. The angle between the first and second sloped surfaces is between about 46 degrees and about 48 degrees.

According to another aspect, the body of the evaporator fan grille includes a grille panel that defines a grille aperture and a saucer coupled to the grille panel by at least one connecting feature.

According to another aspect, the saucer is generally concentrically aligned with the grille aperture.

According to another aspect, the saucer includes a concave side that faces away from the evaporator fan.

According to yet another aspect, the at least one spacer feature includes a lip that extends along the panel and a plurality of pillars that extend between the lip and the grille panel, wherein a plurality of spacer feature apertures are at least partially defined by the lip and the plurality of pillars.

According to another aspect, the at least one spacer feature comprises a plurality of legs that extends between the panel and the grille panel.

According to another aspect, a fan grille for a refrigeration unit includes a body that includes a grille panel that defines a grille aperture and a saucer coupled to the grille panel by at least one connecting feature, and at least one spacer feature that extends outward from the body.

According to another aspect, the saucer includes a concave side that faces a direction that is opposite of the direction that the at least one spacer feature extends outward from the body.

According to another aspect, the saucer is concentrically aligned with the grille aperture defined by the grille panel.

According to another aspect, the at least one spacer feature includes a lip and a plurality of pillars that extend between the lip and the grille panel. A plurality of spacer feature apertures are at least partially defined by the lip and the plurality of pillars.

According to another aspect, the at least one spacer feature comprises a plurality of legs that extend away from the grille panel.

According to yet another aspect, a refrigeration unit includes a storage compartment, an evaporator compartment, an evaporator disposed within the evaporator compartment, and a drain pan beneath the evaporator. The drain pan includes a first sloped surface that slopes downward generally toward a drain hole of the drain pan and a second sloped surface that slopes generally downward toward the drain pan. The angle between the first and second sloped surfaces is greater than 45 degrees.

According to another aspect, the first sloped surface of the drain pan slopes downward generally toward the drain hole at an angle of about 31 degrees relative to a horizontal plane of the refrigeration unit.

According to another aspect, the second sloped surface of the drain pan slopes downward generally toward the drain hole at an angle of about 15 degrees relative to a horizontal plane of the refrigeration unit.

According to yet another aspect, the angle between the first and second sloped surfaces is between about 46 degrees and about 48 degrees.

According to yet another aspect, a panel is located between the storage and evaporator compartments that defines an opening. The storage compartment is in fluid communication with the evaporator compartment via the opening. An evaporator fan delivers air from the evaporator compartment to the storage compartment via the opening. Further, an evaporator fan grille is coupled to the panel and extends outward therefrom into the storage compartment. The evaporator fan grille includes a body that extends over the opening and that is in a spaced-relationship with the panel, and at least one spacer feature extending from the panel to the body.

According to another aspect, the at least one spacer feature includes a lip that extends along the panel and a plurality of pillars that extend between the lip and the body. A plurality of spacer feature apertures are at least partially defined by the lip and the plurality of pillars.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigeration unit, comprising:

a storage compartment;

an evaporator compartment;

an evaporator disposed within the evaporator compartment;

a drain pan beneath the evaporator and having first and second sloped surfaces;

a panel between the storage compartment and the evaporator compartment that defines an opening, wherein the storage compartment is in fluid communication with the evaporator compartment via the opening;

an evaporator fan that delivers air from the evaporator compartment to the storage compartment via the opening; and an evaporator fan grille coupled to the panel and extending outward therefrom into the storage compartment, the evaporator fan grille comprising:

a body that extends over the opening and that is in a spaced-relationship with the panel; and at least one spacer feature extending from the panel to the body, wherein the at least one spacer feature includes a lip that extends along the panel and a plurality of pillars that extend between the lip and the body, wherein a plurality of spacer feature apertures are at least partially defined by the lip and the plurality of pillars.

2. The refrigeration unit of claim 1, wherein the first sloped surface of the drain pan slopes downward generally toward a drain hole of the drain pan at an angle of about 31 degrees relative to a horizontal plane of the refrigeration unit.

3. The refrigeration unit of claim 2, wherein the second sloped surface of the drain pan slopes downward generally toward the drain hole at an angle of about 15 degrees relative to the horizontal plane of the refrigeration unit.

4. The refrigeration unit of claim 1, wherein the first and second sloped surfaces slope downward generally toward a drain hole of the drain pan, wherein an angle between the first and second sloped surfaces is between about 46 degrees and about 48 degrees.

5. The refrigeration unit of claim 1, wherein the body of the evaporator fan grille includes a grille panel that defines a grille aperture and a saucer coupled to the grille panel by at least one connecting feature.

6. The refrigeration unit of claim 5, wherein the saucer is generally concentrically aligned with the grille aperture.

7. The refrigeration unit of claim 6, wherein the saucer includes a concave side that faces away from the evaporator fan.

8. A fan grille for a refrigeration unit, comprising:

a body that includes a grille panel that defines a grille aperture and a saucer coupled to the grille panel by at least one connecting feature; and at least one spacer feature that extends outward from the body.

9. The fan grille of claim 8, wherein the saucer includes a concave side that faces a direction that is opposite of the direction that the at least one spacer feature extends outward from the body.

10. The fan grille of claim 8, wherein the saucer is concentrically aligned with the grille aperture defined by the grille panel.

11. The fan grille of claim 8, wherein the at least one spacer feature includes a lip and a plurality of pillars that extend between the lip and the grille panel, wherein a plurality of spacer feature apertures are at least partially defined by the lip and the plurality of pillars.

12. The fan grille of claim 8, wherein the at least one spacer feature comprises a plurality of legs that extend away from the grille panel.

13. A refrigeration unit, comprising:

a storage compartment;

an evaporator compartment;

an evaporator disposed within the evaporator compartment; and a drain pan beneath the evaporator that includes a first sloped surface that slopes downward generally toward a drain hole of the drain pan and a second sloped surface that slopes generally downward toward the drain pan, wherein an angle between the first and second sloped surfaces is greater than 45 degrees.

14. The refrigeration unit of claim 13, wherein the first sloped surface of the drain pan slopes downward generally toward the drain hole at an angle of about 31 degrees relative to a horizontal plane of the refrigeration unit.

15. The refrigeration unit of claim 13, wherein the second sloped surface of the drain pan slopes downward generally toward the drain hole at an angle of about 15 degrees relative to a horizontal plane of the refrigeration unit.

16. The refrigeration unit of claim 13, wherein the angle between the first and second sloped surfaces is between about 46 degrees and about 48 degrees.

17. The refrigeration unit of claim 13, further comprising:

a panel between the storage compartment and the evaporator compartment that defines an opening, wherein the storage compartment is in fluid communication with the evaporator compartment via the opening;

an evaporator fan that delivers air from the evaporator compartment to the storage compartment via the opening; and an evaporator fan grille coupled to the panel and extending outward therefrom into the storage compartment, the evaporator fan grille comprising:

a body that extends over the opening and that is in a spaced-relationship with the panel; and at least one spacer feature extending from the panel to the body.

18. The refrigeration unit of claim 17, wherein the at least one spacer feature includes a lip that extends along the panel and a plurality of pillars that extend between the lip and the body, wherein a plurality of spacer feature apertures are at least partially defined by the lip and the plurality of pillars.

* * * * *